US010605467B2

(12) United States Patent
Morikawa et al.

(10) Patent No.: US 10,605,467 B2
(45) Date of Patent: Mar. 31, 2020

(54) OUTDOOR UNIT FOR AIR-CONDITIONING APPARATUS AND METHOD OF PRODUCING OUTDOOR UNIT FOR AIR-CONDITIONING APPARATUS

(71) Applicant: Mitsubishi Electric Corporation, Tokyo (JP)

(72) Inventors: Yudai Morikawa, Tokyo (JP); Shinji Kobayashi, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 287 days.

(21) Appl. No.: 15/569,786

(22) PCT Filed: Jun. 16, 2015

(86) PCT No.: PCT/JP2015/067332
§ 371 (c)(1),
(2) Date: Oct. 27, 2017

(87) PCT Pub. No.: WO2016/203549
PCT Pub. Date: Dec. 22, 2016

(65) Prior Publication Data

US 2018/0142908 A1 May 24, 2018

(51) Int. Cl.
*F24H 3/02* (2006.01)
*F24F 1/16* (2011.01)
(Continued)

(52) U.S. Cl.
CPC ..... *F24F 1/16* (2013.01); *F24F 1/36* (2013.01); *F24F 1/50* (2013.01); *F24F 13/222* (2013.01); *B21D 53/02* (2013.01); *F28F 3/08* (2013.01)

(58) Field of Classification Search
CPC ..... F24F 1/16; F24F 1/50; B21D 53/02; F28F 3/08
(Continued)

(56) References Cited

U.S. PATENT DOCUMENTS 2,038,912 A * 4/1936 Summers ..... F25B 39/04 165/150
2,896,887 A * 7/1959 Beltz ..... F16L 3/223 248/49
(Continued)

FOREIGN PATENT DOCUMENTS

JP 58-174667 U 11/1983
JP 02-050033 A 2/1990
(Continued)

OTHER PUBLICATIONS

International Search Report of the International Searching Authority dated Sep. 8, 2015 for the corresponding International application No. PCT/JP2015/067332 (and English translation).
(Continued)

*Primary Examiner* — Claire E Rojohn, III
(74) *Attorney, Agent, or Firm* — Posz Law Group, PLC

(57) ABSTRACT

An outdoor unit for an air-conditioning apparatus prevents dew condensation water from remaining at a lower portion of a heat exchanger and prevents the flow rate of air passing through the heat exchanger from being decreased, and a method of producing the outdoor unit for an air-conditioning apparatus. The outdoor unit includes a housing including a bottom plate, and a frame at an upper end portion of the housing, a heat exchanger including a plurality of fins arranged in parallel at intervals and heat-transfer pipes penetrating the plurality of fins, and a support member including a first support portion engaged with the frame, a fourth support piece perpendicularly extending from the first support portion, and an engagement piece erected on the
(Continued)

fourth support piece and holding the heat-transfer pipes, and the support member supports the heat exchanger such that the heat exchanger is away from the bottom plate.

12 Claims, 8 Drawing Sheets

(51) Int. Cl.

| | |
|---|---|
| ***F24F 1/50*** | (2011.01) |
| ***F24F 13/22*** | (2006.01) |
| ***F24F 1/36*** | (2011.01) |
| *B21D 53/02* | (2006.01) |
| *F28F 3/08* | (2006.01) |

(58) Field of Classification Search
USPC ..... 165/121
See application file for complete search history.

(56) References Cited

U.S. PATENT DOCUMENTS 2,980,404 A * 4/1961 Andersen ..... F28F 9/0132 165/172
3,285,334 A * 11/1966 Pasternak ..... F28F 1/22 165/172
3,292,691 A * 12/1966 Welter ..... F28F 9/0132 165/162
3,503,440 A * 3/1970 Romanos ..... F28D 7/06 165/162
3,575,236 A * 4/1971 Romanos ..... F22B 37/206 165/162
3,854,529 A * 12/1974 Sagan ..... F28F 9/0136 165/162
3,998,268 A * 12/1976 Sagan ..... F28F 9/0132 165/162
4,099,555 A * 7/1978 Margen ..... F28D 1/0472 165/129
4,167,211 A * 9/1979 Haller ..... F28F 9/0132 165/162
4,220,199 A * 9/1980 Romanos ..... F28F 9/0135 122/510
4,244,542 A * 1/1981 Mathews ..... F16L 3/222 138/112
4,337,827 A * 7/1982 Jabsen ..... F28F 9/0135 122/510
4,537,157 A * 8/1985 Volks ..... F22D 1/32 122/412
4,616,390 A * 10/1986 MacCracken ..... F28D 20/021 165/162
4,616,486 A * 10/1986 Ohashi ..... E04H 3/16 165/172
4,657,069 A * 4/1987 Easton ..... F16L 3/13 165/171
5,109,920 A * 5/1992 Merryfull ..... B29C 53/083 165/163
D331,194 S * 11/1992 Pezzoli ..... D9/434
5,224,674 A * 7/1993 Simons ..... F16L 3/2235 248/68.1
5,467,948 A * 11/1995 Gillespie ..... F16L 3/221 248/175
5,485,879 A * 1/1996 Lannes ..... F24D 3/082 122/15.1
5,626,379 A * 5/1997 Scott ..... A47B 81/005 211/195
6,082,448 A * 7/2000 Haussmann ..... F28D 1/05391 165/158
6,216,776 B1 * 4/2001 Kobayashi ..... F28D 1/05383 165/110
6,581,273 B1 * 6/2003 Rhodes ..... B23K 37/0443 29/726.5
6,675,884 B1 * 1/2004 Shen ..... B21D 53/085 165/181
6,772,832 B2 * 8/2004 Schneider ..... F22B 37/206 165/162
7,178,579 B2 * 2/2007 Kolb ..... F02B 29/0412 123/563
D538,180 S * 3/2007 Horton ..... D9/752
D568,254 S * 5/2008 Patchett ..... D13/155
8,151,871 B2 * 4/2012 Forster ..... F28D 1/05366 165/173
D680,773 S * 4/2013 Tebbe ..... D6/682.4
D757,915 S * 5/2016 Morikawa ..... D23/314
9,404,676 B2 * 8/2016 Palmieri ..... F24S 10/70
D776,956 S * 1/2017 Ma ..... D6/552
D777,254 S * 1/2017 Condren ..... D19/65
D814,003 S * 3/2018 Morikawa ..... D23/351
D814,004 S * 3/2018 Morikawa ..... D23/351
D832,346 S * 10/2018 Condren ..... D19/65
2003/0066633 A1 * 4/2003 Lee ..... F25B 39/02 165/144
2013/0031921 A1 * 2/2013 Hamada ..... F24F 13/222 62/155
2014/0224457 A1 * 8/2014 Suzuki ..... F24F 1/16 165/121
2015/0027670 A1 * 1/2015 Jinnai ..... F24F 1/46 165/121
2016/0146476 A1 5/2016 Morikawa et al.

FOREIGN PATENT DOCUMENTS

| | | | | |
|---|---|---|---|---|
| JP | H09-145095 | A | 6/1997 | |
| JP | 2007-010269 | A | 1/2009 | |
| JP | 2009-079851 | A | 4/2009 | |
| JP | 2010169311 | A * | 8/2010 | |
| JP | 2012-225563 | A | 11/2012 | |
| JP | 2013083422 | A * | 5/2013 | F24F 1/50 |
| WO | 2014/199515 | A1 | 12/2014 | |
| WO | WO-2014199515 | A1 * | 12/2014 | |

OTHER PUBLICATIONS

Office action dated Jun. 19, 2018 issued in corresponding JP patent application No. 2017-524182 (and English translation thereof).

* cited by examiner

OUTDOOR UNIT FOR AIR-CONDITIONING APPARATUS AND METHOD OF PRODUCING OUTDOOR UNIT FOR AIR-CONDITIONING APPARATUS

CROSS REFERENCE TO RELATED APPLICATION

This application is a U.S. national stage application of International Application No. PCT/JP2015/067332, filed on Jun. 16, 2015, the contents of which are incorporated herein by reference.

TECHNICAL FIELD

The present invention relates to an outdoor unit for an air-conditioning apparatus, the outdoor unit having a mechanism to fix a heat exchanger to an upper portion of the outdoor unit, and a method of producing the outdoor unit for an air-conditioning apparatus.

BACKGROUND

In recent years, in an outdoor unit for an air-conditioning apparatus installed at a building, a commercial facility, or other similar structure, heat exchangers are disposed at the back side and the right and left sides of the outdoor unit. A fan is installed at an upper portion of the outdoor unit. A negative pressure is produced in the outdoor unit by driving the fan, so that the ambient air around the outdoor unit is sucked into the outdoor unit, and heat is exchanged between the air and refrigerant in the heat exchangers.

Each heat exchanger is configured such that heat-transfer pipes penetrate fins in a direction perpendicular to the fins. Each heat-transfer pipe is, for example, a circular pipe, and the fins reject heat transmitted from the circular pipe by the refrigerant moving in the circular pipe. Here, each heat-transfer pipe is described as a circular pipe, but may be, for example, a flattened pipe having a flattened shape.

In the related art, an outdoor unit for an air-conditioning apparatus having a structure in which, in the case where a plurality of heat exchangers are provided, the number of rows of heat-transfer pipes of the heat exchangers is increased by stacking the heat exchangers in the height direction, has been proposed (see, for example, Patent Literature 1). In the plurality of heat exchangers stacked in the height direction, a sheet metal for preventing the heat exchanger at the upper side from falling downward is disposed at an upper portion of the heat exchanger at the lower side. The heat exchanger at the lower side supports and fixes the heat exchanger at the upper side using the sheet metal.

In the heat exchangers disclosed in Patent Literature 1, a bottom plate for supporting a lower end portion of the heat exchanger provided at the lower side is disposed. However, dew condensation water (drain water) generated from the heat exchangers remains on the bottom plate, and thus the fins and the heat-transfer pipes of the heat exchangers may be frozen or corroded by the dew condensation water.

Consequently, an outdoor unit for an air-conditioning apparatus has been proposed in which a plurality of drain water outlets are provided in a bottom plate of the outdoor unit, dew condensation water generated at a heat exchanger is drained through the drain water outlets to prevent freezing and corrosion of fins and heat-transfer pipes of the heat exchanger (see, for example, Patent Literature 2).

In an existing outdoor unit for an air-conditioning apparatus, a slope is provided to a bottom plate of the outdoor unit, and a drain water outlet is provided at the downstream side of the slope so that dew condensation water remaining on the bottom plate is drained through the drain water outlet by using the slope.

For example, an outdoor unit for an air-conditioning apparatus has also been proposed in which a plurality of louver-like cut-and-raised parts are provided on a bottom plate of the outdoor unit for an air-conditioning apparatus at a position at which a heat exchanger is placed so that the strength of the bottom plate is enhanced while the efficiency of draining dew condensation water generated at the heat exchanger is improved (see, for example, Patent Literature 3).

Furthermore, an outdoor unit for an air-conditioning apparatus has been proposed in which heat pipes are disposed at the lowermost stage of a heat exchanger provided in the outdoor unit for an air-conditioning apparatus so that dew condensation water generated at the heat exchanger is heated to avoid freezing of the dew condensation water (see, for example, Patent Literature 4).

PATENT LITERATURE

Patent Literature 1: Japanese Unexamined Patent Application Publication No. 2009-79851

Patent Literature 2: Japanese Unexamined Patent Application Publication No. 2012-225563

Patent Literature 3: Japanese Unexamined Patent Application Publication No. 9-145095

Patent Literature 4: Japanese Unexamined Patent Application Publication No. 2007-10269

In the outdoor unit for an air-conditioning apparatus disclosed in Patent Literature 1, it is possible to support the heat exchanger disposed at the upper stage side, without a decrease in the strength of the bottom plate, which supports the heat exchanger at the lower stage side. However, as the heat exchangers are disposed vertically, the flow rate of outside air passing through the heat exchanger at the lower stage side decreases. In addition, as the bottom plate of the outdoor unit supports a lower portion of the heat exchanger at the lower stage side, a problem is caused in that dew condensation water generated at the heat exchanger is easily frozen at a lower portion of the heat exchanger.

In the outdoor unit for an air-conditioning apparatus disclosed in Patent Literature 2, the drain water outlets are provided at a laterally intermediate position of a long-side portion of the heat exchanger and at the front side of a short-side portion of the heat exchanger. Thus, dew condensation water generated at the heat exchanger is drained without remaining on the bottom plate. However, due to the structure in which the plurality of drain water outlets are provided in the bottom plate, problems are caused in that the strength of the bottom plate decreases and wind flows in through the drain water outlets to decrease the flow rate of wind passing through the heat exchanger.

In the outdoor unit for an air-conditioning apparatus, the number of drain water outlets is decreased by providing the slope to the bottom plate, but dew condensation water may remain on the bottom plate depending on the angle of the slope. Thus, problems are caused in that dew condensation water remains between the lower portion of the heat exchanger and the bottom plate, so that the heat-transfer pipes of the heat exchanger are corroded, and dew condensation water remaining between the lower portion of the heat exchanger and the bottom plate is frozen, so that the heat-transfer pipes of the heat exchanger are broken.

In the outdoor unit for an air-conditioning apparatus disclosed in Patent Literature 3, draining of dew condensation water is prompted by the louver-like cut-and-raised parts while a decrease in the strength of the bottom plate is avoided. However, as the area of the open space between the bottom plate and the heat exchanger is increased as a whole, a problem is caused in that the flow rate of wind passing through the heat exchanger decreases.

In the outdoor unit for an air-conditioning apparatus disclosed in Patent Literature 4, as the heat pipes are formed, the shape of the bottom plate is not changed. Thus, the strength of the bottom plate is not decreased, and the flow rate of wind passing through the heat exchanger is not decreased. However, the cost is increased by providing the heat pipe. In addition, a problem is caused in that dew condensation water remains on the bottom plate when a heater for the heat pipes is broken down.

SUMMARY

The present invention has been made in view of the above-described problems, and provides an outdoor unit for an air-conditioning apparatus that prevents dew condensation water from remaining at a lower portion of a heat exchanger and prevents the flow rate of air passing through the heat exchanger from being decreased, and a method of producing the outdoor unit for an air-conditioning apparatus.

An outdoor unit for an air-conditioning apparatus according to one embodiment of the present invention includes a housing including a bottom plate, and a frame at an upper end portion of the housing, a heat exchanger disposed in the housing and including a plurality of fins arranged in parallel at intervals, and heat-transfer pipes penetrating the plurality of fins and arranged in a height direction at intervals, and a support member including a first support portion engaged with the frame, a support piece perpendicularly extending from an end portion of the first support portion, and a second support portion erected on the support piece and holding the heat-transfer pipes, and the support member supports the heat exchanger such that the heat exchanger is away from the bottom plate.

According to one embodiment of the present invention, the outdoor unit for an air-conditioning apparatus includes the support member including the first support portion engaged with the frame, the support piece perpendicularly extending from the one end portion of the first support portion, and the second support portion erected on the support piece and holding the heat-transfer pipes, and the support member is configured to support the heat exchanger such that the heat exchanger is away from the bottom plate. With this configuration, it is possible to provide a structure in which dew condensation water does not remain at the lower portion of the heat exchanger, and it is possible to obtain the outdoor unit for an air-conditioning apparatus that does not decrease the flow rate of air passing through the heat exchanger while preventing breakage of the heat-transfer pipes and the fins of the heat exchanger due to freezing of dew condensation water.

DETAILED DESCRIPTION

Figure 1:
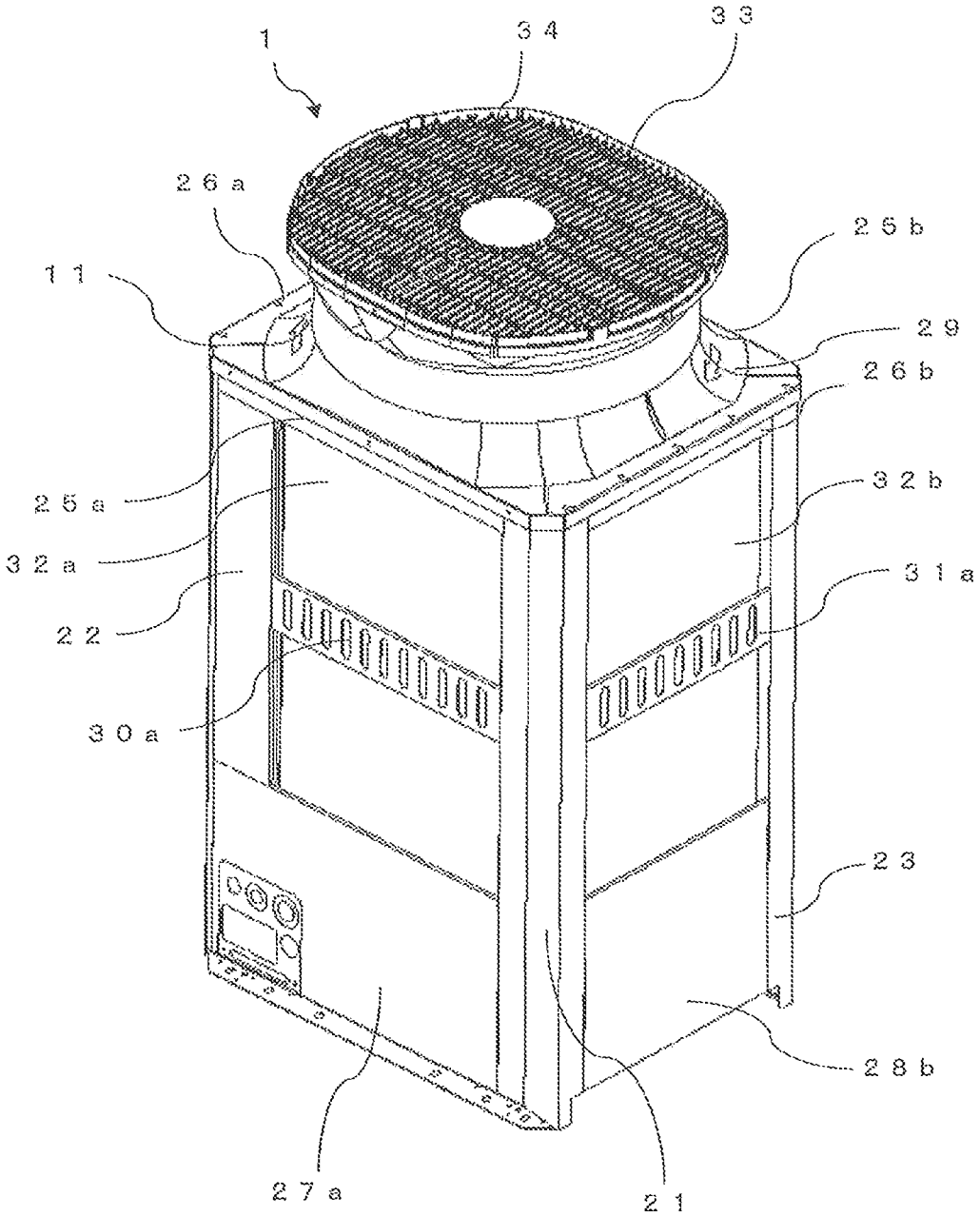
FIG. 1 is a schematic perspective view of an outdoor unit for an air-conditioning apparatus according to Embodiment 1 of the present invention.

Hereinafter, Embodiments of the outdoor unit for an air-conditioning apparatus of the present invention will be described with reference to the drawings. It should be noted that Embodiments of the drawings are examples and the present invention is not limited to Embodiments of the drawings. In addition, in each drawing, components designated by the same reference signs are the same or equivalent components, and the same reference signs are common throughout the specification. Furthermore, the relationship of the sizes of components in the drawings described below may be different from actual relationship.

Embodiment 1

[Configuration of Outdoor Unit for an Air-Conditioning Apparatus]

FIG. 1 is a schematic perspective view of an outdoor unit for an air-conditioning apparatus according to Embodiment 1 of the present invention. As shown in FIG. 1, an outdoor unit 1 includes a housing 11 at an outer surface side. At corner portions of the housing 11, as seen from the front, a right front surface panel 21 is provided at the front and right side, a right back surface panel 23 is provided at the back side of the right front surface panel 21, a left front surface panel 22 is provided at the front and left side, and a left back surface panel (not shown) is provided at the back side of the left front surface panel 22.

A front frame 25*a* is bridged over upper end portions of the right front surface panel 21 and the left front surface panel 22. A right frame 26*b* is bridged over the upper end portion of the right front surface panel 21 and an upper end portion of the right back surface panel 23. A left frame 26*a* is bridged over the upper end portion of the left front surface panel 22 and an upper end portion of the left back surface panel. A back frame 25*b* is bridged over the upper end portions of the left back surface panel and the right back surface panel 23. The front frame 25*a*, the back frame 25*b*, the left frame 26*a*, and the right frame 26*b* each correspond to a "frame" in the present invention. In addition, when the front frame 25*a*, the back frame 25*b*, the left frame 26*a*, and the right frame 26*b* are not particularly distinguished from each other, the front frame 25*a*, the back frame 25*b*, the left frame 26*a*, and the right frame 26*b* are referred to as frames 25*a*, 25*b*, 26*a*, and 26*b*.

In addition, a lower front surface panel 27*a* is provided at a lower portion of the front surface of the housing 11. The lower front surface panel 27*a* is detachable or openable-closable. When an operator performs maintenance or other related work in the interior of the housing 11, the lower front surface panel 27*a* is detached or opened-closed. A right lower panel 28*b* is provided at a lower portion of the right side surface of the housing 11. A left lower panel (not shown) is provided at a lower portion of the left side surface of the housing 11. A lower back surface panel (not shown) is provided at a lower portion of the back side of the housing 11. Similarly to the lower front surface panel 27*a*, if the right lower panel 28*b*, the left lower panel, and the lower back surface panel are detachable or openable-closable, the right lower panel 28*b*, the left lower panel, and the lower back surface panel can be detached or opened-closed when the operator performs maintenance or other related work in the interior of the housing 11.

Air inlets 32*a* and 32*b* and other air inlets (not shown) through which air is sucked into the housing 11 are each provided in a corresponding one of the front, back, right, and left side surfaces of the housing 11. The air inlet 32*a* is formed by being surrounded by the right front surface panel 21, the left front surface panel 22, the front frame 25*a*, and the lower front surface panel 27*a*. The air inlet 32*b* is formed by being surrounded by the right front surface panel 21, the right back surface panel 23, the right frame 26*b*, and the right lower panel 28*b*. Similarly, the other air inlets (not shown) are formed in the left side surface portion and the back side surface portion of the housing 11.

A front guard 30*a* is provided at a center portion of the air inlet 32*a* to connect the right front surface panel 21 and the left front surface panel 22. A right guard 31*a* is provided at a center portion of the air inlet 32*b* to connect the right front surface panel 21 and the right back surface panel 23. Similarly, a left guard (not shown) is provided at the air inlet in the left side surface portion of the housing 11, and a back guard (not shown) is provided at the air inlet in the back side surface portion of the housing 11.

An upper surface panel 29 is provided at an upper portion of the housing 11, and an air outlet 33 that is an opening for blowing out air is formed in the upper surface panel 29. In addition, a fan 34 is provided at the upper portion of the housing 11. A negative pressure is produced in the housing 11 by driving the fan 34, so that air is sucked into the housing 11 through the air inlet 32*a* and the other air inlets provided in the front, back, right, and left portions of the housing 11. The air sucked into the housing 11 is blown out through the air outlet 33 by the fan 34.

Although the housing 11 of the outdoor unit 1 for an air-conditioning apparatus has been described above in Embodiment 1, the present invention is not limited to this configuration, and components may be changed as appropriate, for example, another member may be added to the housing 11.

Figure 2:
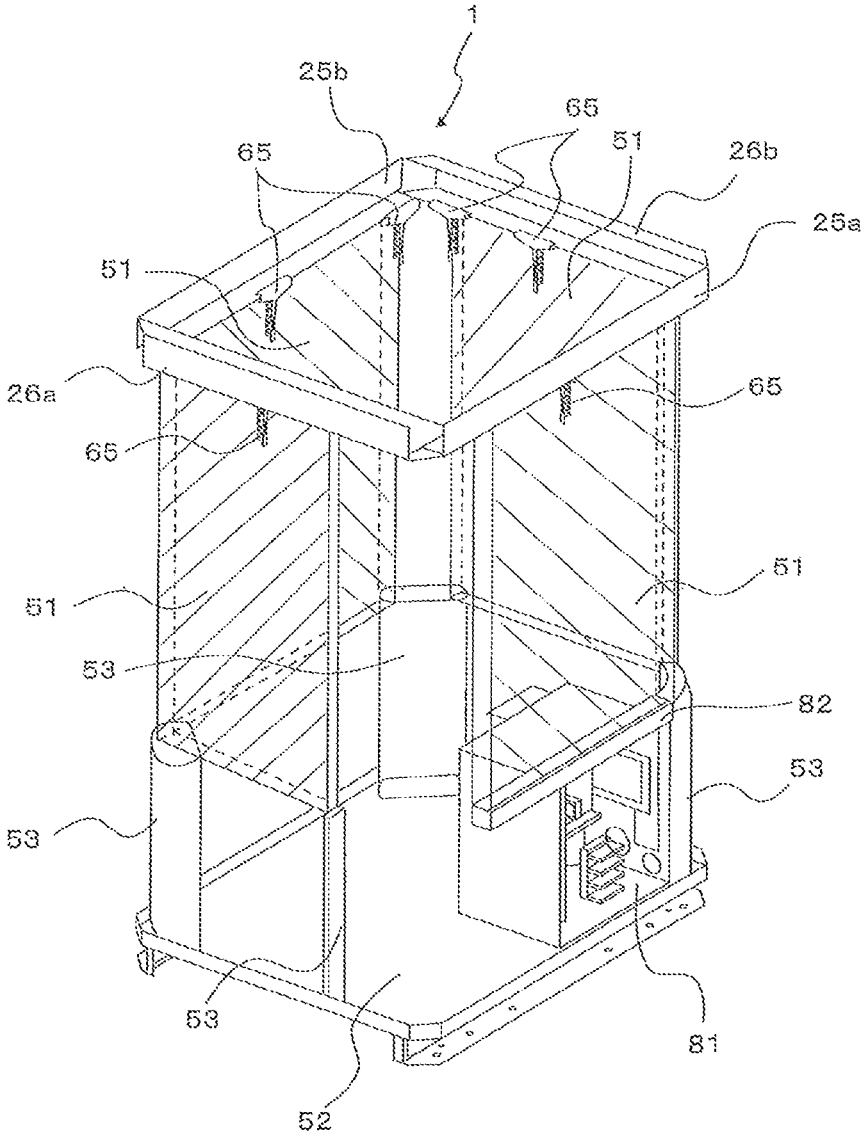
FIG. 2 is an explanatory diagram for explaining a support structure for heat exchangers of the outdoor unit for an air-conditioning apparatus according to Embodiment 1 of the present invention.

FIG. 2 is an explanatory diagram for explaining a support structure for heat exchangers of the outdoor unit for an air-conditioning apparatus according to Embodiment 1 of the present invention. As shown in FIG. 2, four heat exchangers 51 are provided in the outdoor unit 1 at the front, back, right, and left side surfaces. The heat exchangers 51 are each supported by a corresponding one of the front frame 25*a*, the back frame 25*b*, the left frame 26*a*, and the right frame 26*b* using later-described support members 65 to hang the heat exchangers 51 and the heat exchangers 51 are away from a bottom plate 52. The heat exchangers 51 are installed in the vicinity of the fan 34 (see FIG. 1), which is disposed in the upper surface panel 29 (see FIG. 1). In addition, the bottom plate 52 is provided at a lower portion in the outdoor unit 1, and heat exchanger supports 53, an electric component box 81, and a drain receiver 82 described later are provided on the bottom plate 52. Moreover, the bottom plate 52 serves to store dew condensation water dropping from the heat exchangers 51.

The heat exchanger support 53 is provided at a lower portion of each heat exchanger 51. The heat exchanger supports 53 are not necessarily provided for supporting the weights of the heat exchangers 51. For example, the heat exchanger supports 53 are used when the heat exchangers 51 are temporarily placed in assembling the outdoor unit 1 or when the heat exchangers 51 are temporarily placed during service maintenance of the outdoor unit 1. The heat exchanger supports 53 have minimum strength enough to support the weights of the heat exchangers 51, are resinous, and have a simple makeup.

Although the example where the four heat exchangers 51 are used has been described in Embodiment 1, for example, two heat exchangers each having an L shape in a plan view may be used to cover the four side surfaces of the housing 11, or the shapes of the heat exchangers may be changed as appropriate. In addition, in FIG. 2 of Embodiment 1, some of the heat exchangers 51 are each provided with a plurality of the support members 65 as an example, but the present invention is not limited to this configuration, and at least one support member 65 only needs to be provided at each heat exchanger 51. The same applies to Embodiment 2 described later.

Figure 3:
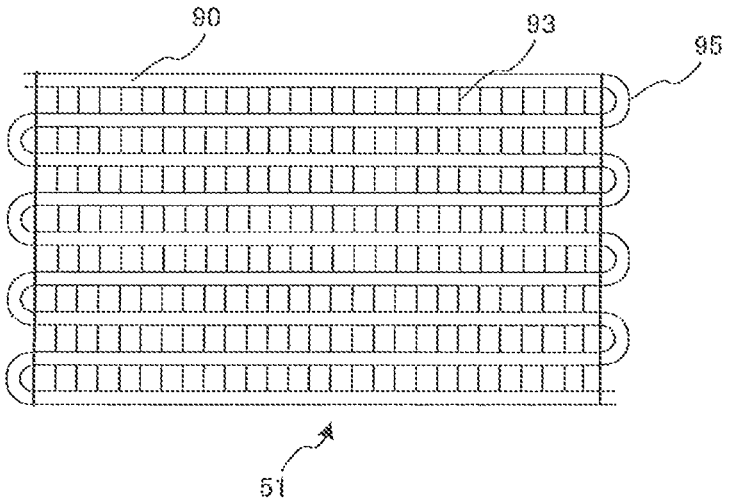
FIG. 3 is a schematic plan view of the heat exchanger of the outdoor unit for an air-conditioning apparatus according to Embodiment 1 of the present invention.

FIG. 3 is a schematic plan view of the heat exchanger of the outdoor unit for an air-conditioning apparatus according to Embodiment 1 of the present invention. As shown in FIG. 3, the heat exchanger 51 includes heat-transfer pipes 90 that extend in the horizontal direction and are disposed in multiple rows in the height direction, and a plurality of fins 93 that are penetrated by the heat-transfer pipes 90. The heat-transfer pipes 90 each are a flattened pipe and are formed from aluminum or an alloy containing aluminum. End portions of the heat-transfer pipes 90 are connected to each other by U-shaped pipe members 95 such that the heat-transfer pipes 90 have a meandering shape in the height direction. Refrigerant sent from a compressor (not shown) flows through the heat-transfer pipes 90, and the refrigerant exchanges heat with air passing through the heat-transfer pipes 90 and the fins 93 in the outdoor unit 1. In Embodiment 1, the heat-transfer pipes 90 are described as the flattened pipes, but the present invention is not limited to this configuration, and circular pipes each having a circular shape may be used.

Figure 4:
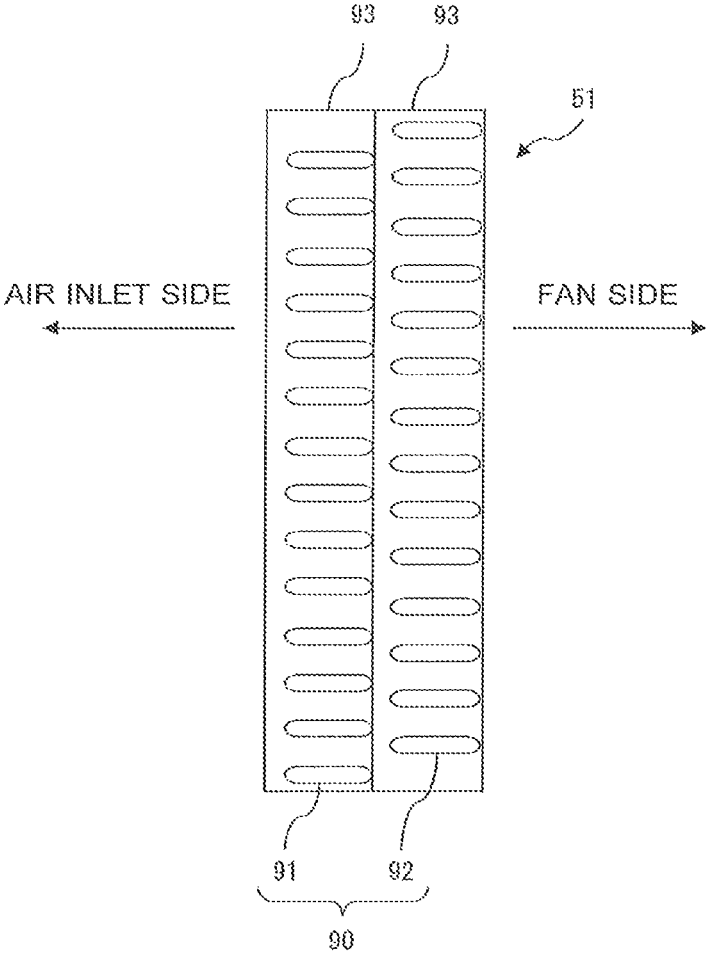
FIG. 4 is a schematic front view of the heat exchanger of the outdoor unit for an air-conditioning apparatus according to Embodiment 1 of the present invention.

FIG. 4 is a schematic front view of the heat exchanger of the outdoor unit for an air-conditioning apparatus according to Embodiment 1 of the present invention. As shown in FIG. 4, the heat-transfer pipes 90 are disposed in multiple rows from the outer side of the outdoor unit 1 to the inner side of the outdoor unit 1. Here, the heat-transfer pipes 90 that are closest to the fan 34 at the inner side of the outdoor unit 1 are referred to as second heat-transfer pipes 92, and the heat-transfer pipes 90 at the air inlet side are referred to as first heat-transfer pipes 91. In Embodiment 1, the example where the first heat-transfer pipes 91 are provided in a single row is shown, but the present invention is not limited to this configuration, and the first heat-transfer pipes 91 may be provided in two or more rows corresponding to the performance or other related aspect of the outdoor unit 1.

Figure 5:
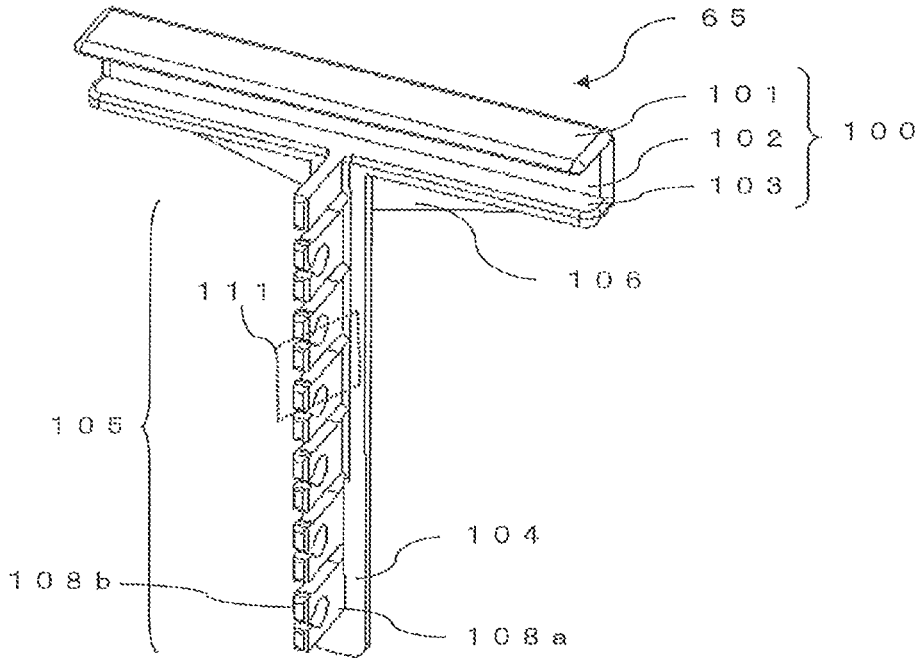
FIG. 5 is a schematic perspective view, from the front side, of a support member of the outdoor unit for an air-conditioning apparatus according to Embodiment 1 of the present invention.
Figure 6:
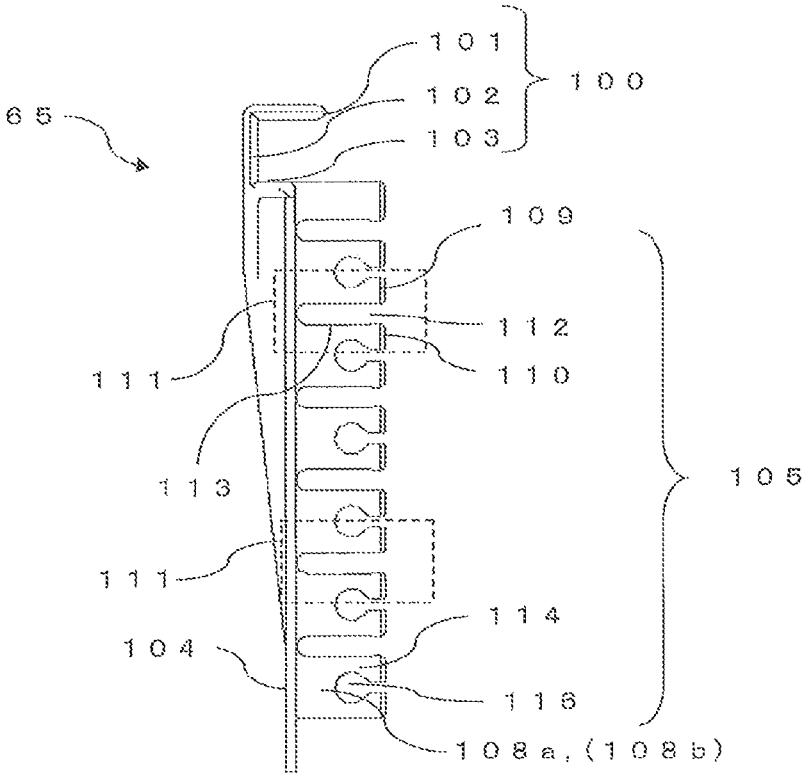
FIG. 6 is a schematic side view of the support member of the outdoor unit for an air-conditioning apparatus according to Embodiment 1 of the present invention.

FIG. 5 is a schematic perspective view, from the front side, of the support member of the outdoor unit for an air-conditioning apparatus according to Embodiment 1 of the present invention. In addition, FIG. 6 is a schematic side view of the support member of the outdoor unit for an air-conditioning apparatus according to Embodiment 1 of the present invention. As shown in FIGS. 5 and 6, the support member 65 is formed integrally by a first support piece 101, a second support piece 102, a third support piece 103, a fourth support piece 104, an engagement piece assembly 105, a first bracing portion 106, and a later-described second bracing portion 107. The support members 65 are each formed from a resin having flexibility.

At an upper portion of the support member 65, a first support portion 100 is provided. The first support portion 100 is formed in a substantially U shape having right-angled corner portions by the plate-like first support piece 101, the second support piece 102, and the third support piece 103. The front frame 25*a*, the back frame 25*b*, the left frame 26, and the right frame 26*b* are each inserted into a corresponding one of the support members 65 from an open surface of the first support portion 100. The support member 65 is supported on each of the front frame 25*a*, the back frame 25*b*, the left frame 26*a*, and the right frame 26*b* by engaging the first support piece 101 with the upper end surface of each of the front frame 25*a*, the back frame 25*b*, the left frame 26*a*, and the right frame 26*b*.

A direction along the longitudinal direction of the upper end surface of the heat exchanger 51 is the longitudinal direction of the first support piece 101. The first support piece 101 of the support member 65 comes into engagement with each of the front frame 25*a* and the other frames and supports the heat exchanger 51. Thus, the support member 65 only needs to have strength enough to be able to support the weight of the heat exchanger 51.

As shown in FIG. 5, the support member 65 includes the fourth support piece 104 that has an elongate plate shape and perpendicularly extends from a center of a lower portion of the third support piece 103. Thus, the support member 65 is formed in a T shape as seen from the front, by the first support portion 100 and the fourth support piece 104. The engagement piece assembly 105 is provided on a surface of the fourth support piece 104 that faces in the same direction as the open surface of the U-shaped first support portion 100. The engagement piece assembly 105 includes a plurality of engagement pieces 111 described later, and the plurality of engagement pieces 111 are erected on the fourth support piece 104 and arranged along the longitudinal direction of the fourth support piece 104 and in series (in one row). The engagement pieces 111 serve to hold the heat-transfer pipes 90 of the heat exchanger 51, and thus the interval between the engagement pieces 111 is predetermined corresponding to the arrangement of the heat-transfer pipes 90. The engagement pieces 111 are each formed, for example, in a comb shape. The fourth support piece 104 corresponds to a "support piece" in the present invention. In addition, the engagement piece 111 corresponds to a "second support portion" in the present invention. In Embodiment 1, the example where the engagement pieces 111 are erected on the fourth support piece 104 and arranged along the longitudinal direction of the fourth support piece 104 in one row is shown, but the present invention is not limited to this configuration, and the engagement pieces 111 may be provided in two or more rows. For example, when the engagement pieces 111 are provided in two or more rows, it is possible to more stably support the heat exchanger 51.

As shown in FIGS. 5 and 6, the side surfaces of each engagement piece 111 are formed by a first side surface portion 108*a* and a second side surface portion 108*b* that opposes the first side surface portion 108*a*. In addition, a distal end portion of each engagement piece 111 is formed by a first end portion 109 and a second end portion 110. The back side of each engagement piece 111 is formed to be integrated with the fourth support piece 104.

As shown in FIG. 6, each engagement piece 111 has a heat-transfer pipe insertion portion 112 that is formed in a notch shape and into which the heat-transfer pipe 90 is inserted, and a heat-transfer pipe holding portion 113 that holds the heat-transfer pipe 90 inserted through the heat-transfer pipe insertion portion 112. The heat-transfer pipe insertion portion 112 is a notch that penetrates between the first end portion 109 and the second end portion 110 of the engagement piece 111 from the first side surface portion 108*a* to the second side surface portion 108*b*. The heat-transfer pipe holding portion 113 is formed by the notch.

The heat-transfer pipe 90 is inserted into each engagement piece 111 through the heat-transfer pipe insertion portion 112, and the inserted heat-transfer pipe 90 is held by the heat-transfer pipe holding portion 113. That is, each engagement piece 111 has a structure in which the heat-transfer pipe 90 is inserted into the engagement piece 111. Furthermore, a notch portion 116 that is formed in a notch shape to penetrate the first side surface portion 108*a* and the second side surface portion 108*b* is provided between the engagement piece 111 and the engagement piece 111, and a spring portion 114 having elasticity is formed by the notch portion 116. The spring portion 114 allows the operator to mount the support member 65 to the heat-transfer pipes 90 of the heat exchanger 51 without using a tool. In addition, it is possible for each engagement piece 111 to ensure strength by the heat-transfer pipe 90 being inserted into the heat-transfer pipe holding portion 113. Furthermore, as the support member 65 including the engagement pieces 111 is formed from a resin having flexibility, even when the heat-transfer pipes 90 have dimensional variations in some degree, it is possible to accept a deviation or other inconvenience due to the variations, and the range of tolerance is wide.

Figure 7:
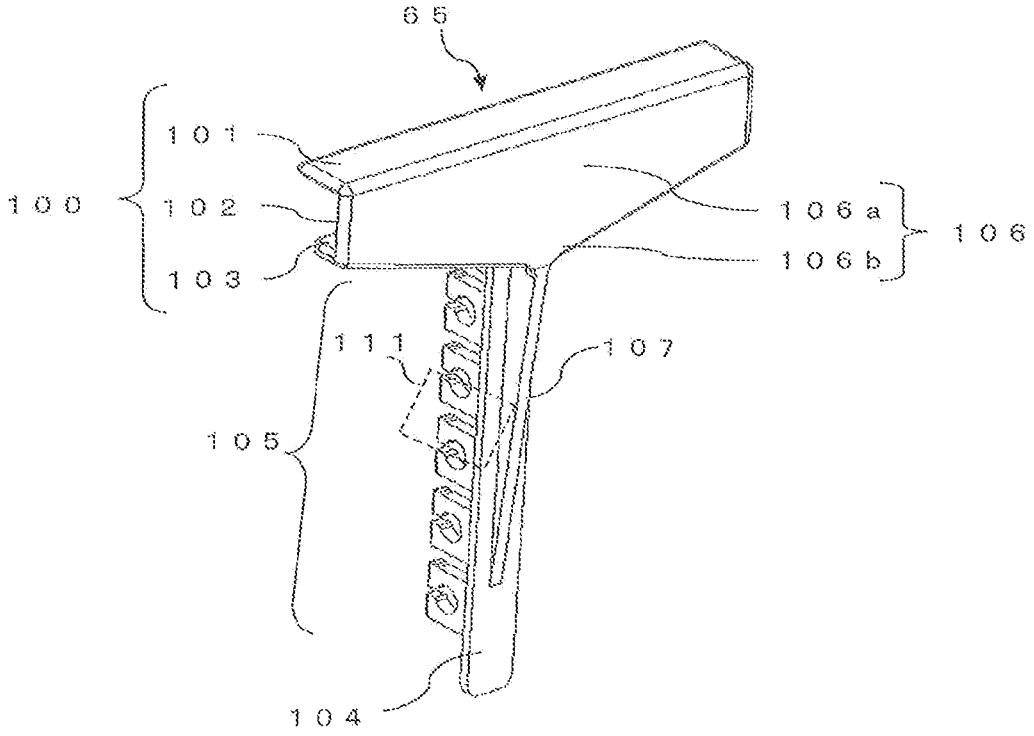
FIG. 7 is a schematic perspective view, from the back side, of the support member of the outdoor unit for an air-conditioning apparatus according to Embodiment 1 of the present invention.

FIG. 7 is a schematic perspective view, from the back side, of the support member of the outdoor unit for an air-conditioning apparatus according to Embodiment 1 of the present invention. As shown in FIG. 7, the first bracing portion 106 includes a first upper bracing portion 106*a* that is provided at an upper portion, and a first lower bracing portion 106*b* that is provided at a lower portion of the first upper bracing portion 106*a* and has a slope at a lower portion. The first upper bracing portion 106*a* is formed to be integrated with the first support portion 100, which includes the first support piece 101, the second support piece 102, and the third support piece 103. Meanwhile, the first lower bracing portion 106*b* is formed to be integrated with the third support piece 103 and supports the first support piece 101 and the second support piece 102. The strength of the support member 65 is enhanced by including the first bracing portion 106.

The second bracing portion 107 is formed to be integrated with the first bracing portion 106, the third support piece 103, and the fourth support piece 104. The second bracing portion 107 is formed at a position at which the second bracing portion 107 is bilaterally symmetrical about the first support portion 100, which includes the first support piece 101, the second support piece 102, and the third support piece 103. The second bracing portion 107 supports the first support piece 101, the second support piece 102, the third support piece 103, and the fourth support piece 104. Similarly to the first bracing portion 106, the strength of the support member 65 is enhanced by including the second bracing portion 107.

The example where the support member 65 is formed from a resin having flexibility has been described above, but the present invention is not limited to this configuration. For example, the support member 65 may be formed from an insulator having flexibility. In addition, for example, the support member 65 may be formed by pouring a melted material into a mold, may be formed by pressing, or may be formed by cutting, and the processing method is not particularly limited. Moreover, the support member 65 may be formed from a thermoplastic resin that becomes softened by heat that considerably exceeds heat generated at the heat exchanger 51.

The inner portion of the support member 65 may be formed from a conductor, and the outer surface of the support member 65 may be coated with an insulator. For example, when the heat-transfer pipes 90 are assumed to be formed from aluminum or an alloy containing aluminum, if the support member 65 is an insulating member, the heat-transfer pipes 90 and the support member 65 are not conducted to each other via dew condensation water. In other words, of the support member 65, portions that are in contact with the heat-transfer pipes 90 are formed from an insulating material other than metal such as aluminum as in the heat-transfer pipes 90. Thus, even when dew condensation water remains between the heat-transfer pipes 90 and the support member 65, the heat-transfer pipes 90 and the support member 65 are not conducted to each other, and thus it is possible to avoid corrosion that is due to contact between different types of metals.

Figure 8:
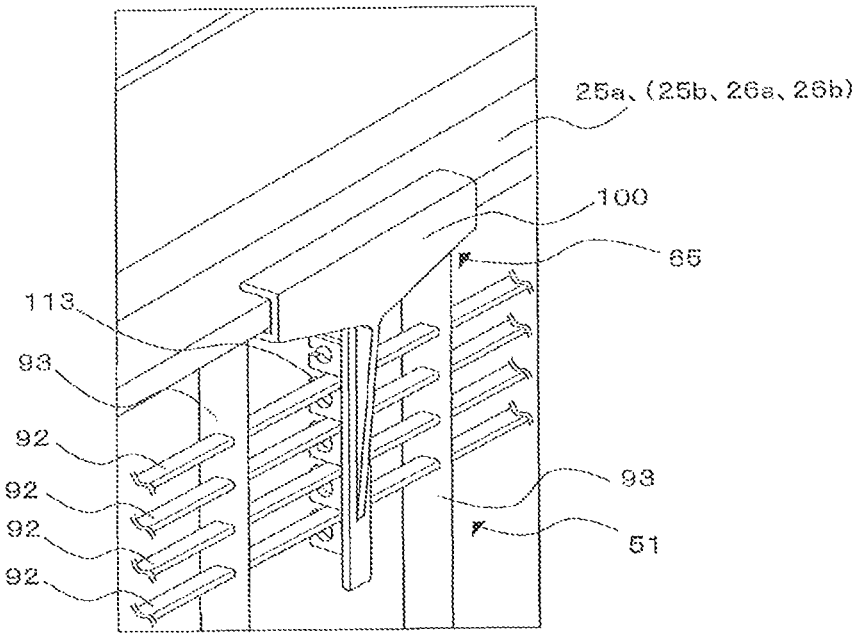
FIG. 8 is a schematic perspective view showing a state where the support member of the outdoor unit for an air-conditioning apparatus according to Embodiment 1 of the present invention holds the heat exchanger.

FIG. 8 is a schematic perspective view showing a state where the support member of the outdoor unit for an air-conditioning apparatus according to Embodiment 1 of the present invention holds the heat exchanger. The outdoor unit 1 includes the front frame 25*a*, the back frame 25*b*, the left frame 26*a*, and the right frame 26*b*. Each frame has the same structure, and thus the case where the support member 65 is engaged with the front frame 25*a* will be described below as an example.

As shown in FIG. 8, the first support portion 100 of the support member 65 is engaged with the front frame 25*a* in the horizontal direction. Of the heat-transfer pipes 90 of the heat exchanger 51, the second heat-transfer pipes 92, which are closest to the fan 34 and are at the upper side of the heat exchanger 51, are inserted through the heat-transfer pipe insertion portions 112 (see FIG. 6), and held by the heat-transfer pipe holding portions 113 of the support member 65 over the height direction. That is, the heat exchanger 51 is lifted only with contact surfaces between the second heat-transfer pipes 92 and the heat-transfer pipe holding portions 113 so that the heat exchanger 51 is away from the bottom plate 52 (see FIG. 2), and the heat exchanger 51 is held at the upper side of the housing 11. The second heat-transfer pipes 92 held by the heat-transfer pipe holding portions 113 are provided within a certain range (upper side) of the heat exchanger 51. The heat-transfer pipe holding portion 113 of each engagement piece 111 holds at least the uppermost second heat-transfer pipe 92 of the second heat-transfer pipes 92.

As described above, the support member 65 supports the heat exchanger 51 in the height direction and in the horizontal direction by coming into engagement with front frame 25*a*. In addition, the heat-transfer pipe holding portions 113 of engagement pieces 111 hold the heat exchanger 51 in the height direction by holding the second heat-transfer pipes 92.

In Embodiment 1, the example where the second heat-transfer pipes 92 are held by the heat-transfer pipe holding portions 113 only in one vertical row is shown, but the present invention is not limited to this configuration, and the heat-transfer pipes 90 (the first heat-transfer pipes 91 and the second heat-transfer pipes 92) may be held by the same heat-transfer pipe holding portions 113 in multiple rows. In the case where the heat-transfer pipes 90 in multiple rows are held by the same heat-transfer pipe holding portions 113, it is possible to obtain an effect that the heat exchanger 51 is more stably held.

Figure 9:
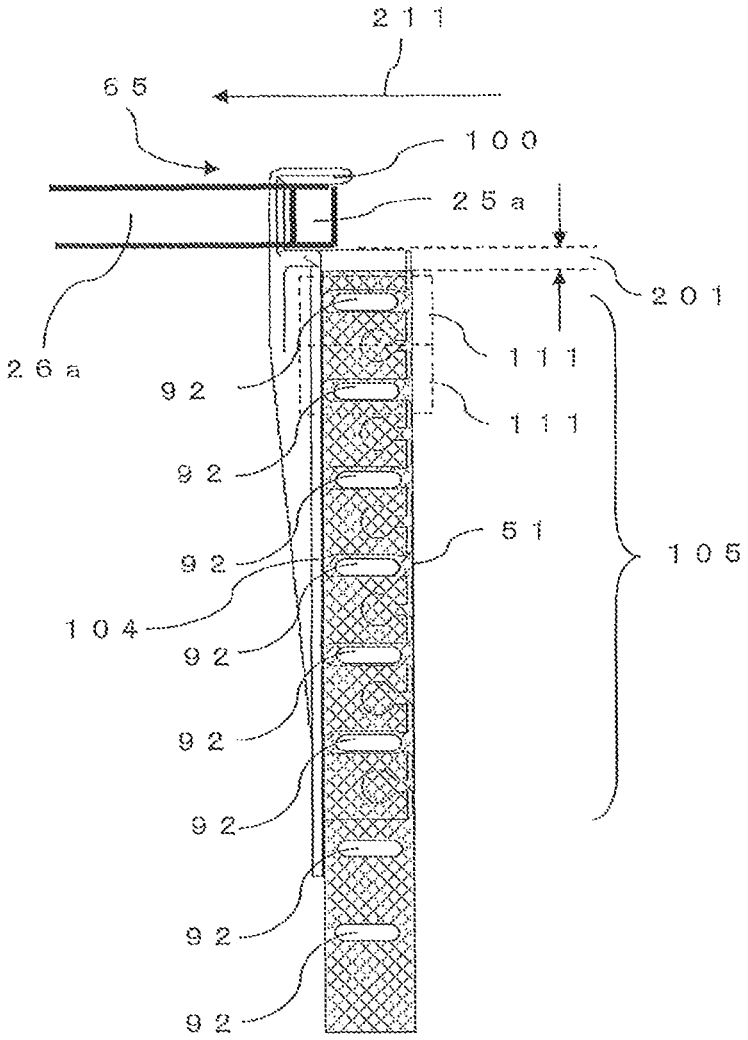
FIG. 9 is a schematic cross-sectional view showing a state where the heat exchanger mounted in the outdoor unit for an air-conditioning apparatus according to Embodiment 1 of the present invention is mounted to a frame via the support member.

FIG. 9 is a schematic cross-sectional view showing a state where the heat exchanger mounted in the outdoor unit for an air-conditioning apparatus according to Embodiment 1 of the present invention is mounted on the frame via the support member. FIG. 9 shows the case where the support member 65 is engaged with the front frame 25*a*, for example. As shown in FIG. 9, the plurality of engagement pieces 111 of the support member 65 are formed along the longitudinal direction of the fourth support piece 104 and at predetermined regular intervals corresponding to arrangement of the second heat-transfer pipes 92. It should be noted that the engagement pieces 111 are provided at a position such that a gap 201 is present between the front frame 25*a* and the upper end surface of the heat exchanger 51 when the heat exchanger 51 is mounted on the support member 65. With this configuration, the heat exchanger 51 does not interfere with the front frame 25*a*, which is disposed at the upper portion of the heat exchanger 51, and it is possible to prevent breakage of the heat exchanger 51.

Here, when the fan 34 (see FIG. 1) is operating, the ambient air around the housing 11 is sucked through the air inlet, and wind 211 starts flowing to the heat exchanger 51 as shown by an arrow in FIG. 9. As the support member 65 is disposed in the vicinity of the fan 34 along the flow direction of the wind 211, the wind flows through the heat exchanger 51 at the highest wind speed. Thus, dew condensation water generated at the heat exchanger 51 drops to the lower portion of the outdoor unit 1 without remaining at the heat exchanger 51.

As the support member 65 is formed from a resin having flexibility, even when vibration occurs due to operation of the outdoor unit 1 or due to transport of the outdoor unit 1, the support member 65 is able to absorb the vibration or other inconvenience and support the heat exchanger 51.

Thus, it is possible to assuredly avoid a situation in which the heat exchanger 51 falls off.

The case where the support member 65 is engaged with the front frame 25*a* has been described above as an example, but the gap 201 is similarly provided between each frame and the heat exchanger 51 when the support members 65 are engaged with the back frame 25*b*, the left frame 26*a*, and the right frame 26*b*.

Next, a method of producing the outdoor unit 1, in which the heat exchangers 51 are held by the support members 65, will be described. First, the first support portions 100 of the support members 65 are each engaged with the front frame 25*a*, the back frame 25*b*, the left frame 26*a*, and the right frame 26*b*. Next, the heat exchangers 51 are each mounted to a corresponding one of the support members 65 from the outer portion side of the outdoor unit 1. In this case, each heat exchanger 51 is mounted such that at least the second heat-transfer pipes 92 of the heat-transfer pipes 90 of the heat exchanger 51 are held by the heat-transfer pipe holding portions 113 of the support member 65. With this method, it is possible to easily mount the heat exchangers 51 in the vicinity of the fan 34, and it is possible to obtain the outdoor unit 1 for an air-conditioning apparatus that prevents a decrease in the flow rate of air passing through the heat exchangers 51. In addition, by each heat exchanger 51 being hung to the support member 65, each heat exchanger 51 is prevented from coming into contact with drain water remaining at the bottom plate 52, and thus it is possible to obtain the outdoor unit 1 for an air-conditioning apparatus that is able to prevent freezing and corrosion of the heat-transfer pipes 90.

Advantageous Effects of Embodiment 1

From the above, according to Embodiment 1, the outdoor unit 1 includes the housing 11 including the bottom plate 52, and the frame 25*a*, 25*b*, 26*a*, or 26*b* at an upper end portion of the housing 11, the heat exchanger 51 disposed in the housing 11 and including the plurality of fins 93 arranged in parallel at intervals and the heat-transfer pipes 90 penetrating the plurality of fins 93 and arranged in the height direction at intervals, and the support member 65 including the first support portion 100 engaged with the frame 25*a*, 25*b*, 26*a*, or 26*b*, the fourth support piece 104 perpendicularly extending from one end portion of the first support portion 100, and the engagement piece 111 erected on the fourth support piece 104 and holding the heat-transfer pipes 90, and the support member 65 supports the heat exchanger 51 such that the heat exchanger 51 is away from the bottom plate 52. With this configuration, it is unnecessary to provide a plurality of drain water outlets in the bottom plate 52 of the outdoor unit 1, and it is possible to obtain the outdoor unit 1 for an air-conditioning apparatus that does not decrease the flow rate of wind passing through the heat exchanger 51. In addition, by the support member 65 supporting the heat exchanger 51 disposed at the upper stage side, it is possible to obtain the outdoor unit 1 for an air-conditioning apparatus that is able to assuredly avoid falling-off of the heat exchanger 51 disposed at the upper stage side at low cost even when vibration occurs due to operation or due to transport. Furthermore, by hanging the heat exchanger 51 at the frame 25*a*, 25*b*, 26*a*, or 26*b* that is provided at the upper portion of the housing 11, dew condensation water does not remain between the lower portion of the heat exchanger 51 and the bottom plate 52, and it is possible to obtain the outdoor unit 1 for an air-conditioning apparatus that is able to avoid breakage of the heat-transfer pipes 90 that is due to freezing of the dew condensation water. Moreover, by hanging the heat exchanger 51 in the vicinity of the fan 34, it is possible to obtain the outdoor unit 1 for an air-conditioning apparatus that does not decrease the flow rate of air passing through the heat exchanger 51.

The support member 65 supports the heat exchanger 51 in the height direction and in the horizontal direction by the first support portion 100 being engaged with the frame 25*a*, 25*b*, 26*a*, or 26*b*, and supports the heat exchanger 51 in the height direction by the engagement pieces 111 holding the heat-transfer pipes 90. With this configuration, it is possible to stably hold the heat exchanger 51 in the outdoor unit 1.

A plurality of the engagement pieces 111 are provided in the height direction, and the plurality of the engagement pieces 111 are formed in the longitudinal direction of the fourth support piece 104 at the same intervals as a certain range of the heat-transfer pipes 90. With this configuration, it is possible to hold each one of the heat-transfer pipes 90 by a corresponding one of the plurality of the engagement pieces 111, and it is possible to hold the heat exchanger 51 more stably than when the heat exchanger 51 is held by one engagement piece 111.

The support member 65 provides a gap between the frame 25*a*, 25*b*, 26*a*, or 26*b* and the upper end surface of the heat exchanger 51. With this configuration, the heat exchanger 51 does not interfere with the frame 25*a*, 25*b*, 26*a*, or 26*b* disposed at the upper portion of the heat exchanger 51, and it is possible to prevent breakage of the heat exchanger 51.

In the engagement pieces 111, the notch portions 116 are provided between the engagement pieces 111 to form the spring portions 114. With this configuration, the spring portions 114 allow the operator to mount the support member 65 to the heat-transfer pipes 90 of the heat exchanger 51 without using a tool.

The support member 65 is formed from a resin having flexibility. Consequently, even when vibration or impact is applied to the heat exchanger 51, the flexibility of the support member 65 can stably hold the heat exchanger 51 by absorbing the vibration or the impact.

The heat-transfer pipes 90 are formed from aluminum or an alloy containing aluminum having good thermal conductivity. Consequently, heat is easily rejected from or received by the refrigerant flowing through the heat-transfer pipes 90.

The heat-transfer pipes 90 each have a flattened shape. Consequently, the heat-transfer pipes 90 each have a large surface area as compared to a heat-transfer pipe having a circular pipe shape, so that heat is easily rejected or received.

Embodiment 2

The basic configuration of an outdoor unit for an air-conditioning apparatus according to Embodiment 2 is the same as that of the outdoor unit 1 for an air-conditioning apparatus according to Embodiment 1. Hereinafter, Embodiment 2 will be described mainly regarding the difference from Embodiment 1. The difference between Embodiment 1 and Embodiment 2 is that a drain receiver is provided in the outdoor unit and at an upper portion of the electric component box.

Figure 10:
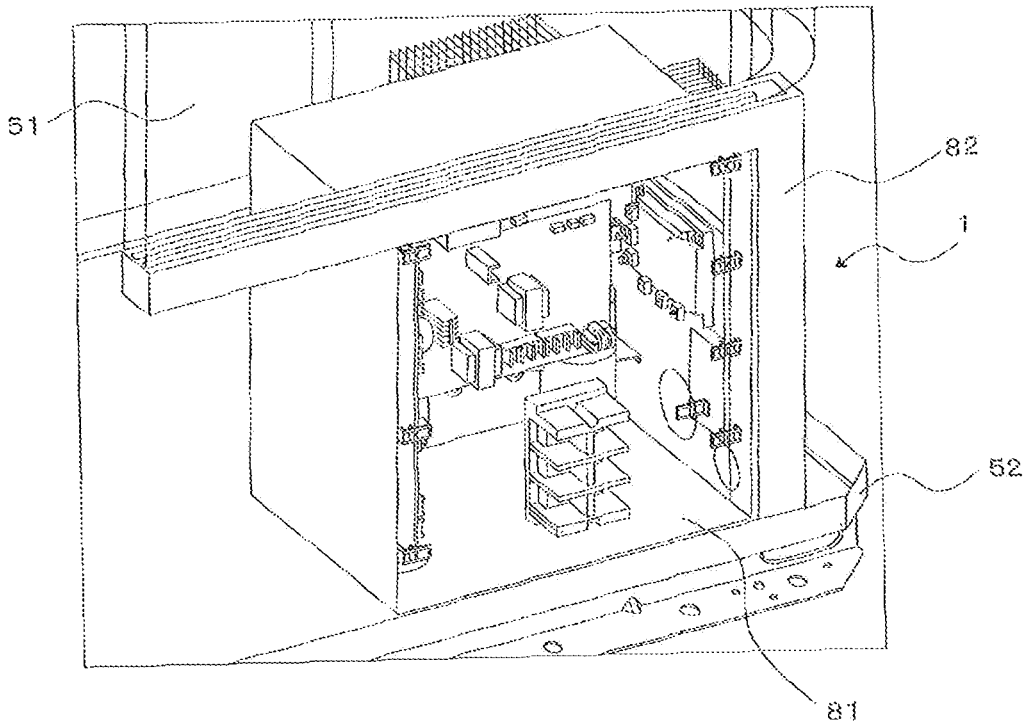
FIG. 10 is a schematic perspective view showing a state of a heat exchanger, a drain receiver, and an electric component box in an outdoor unit for an air-conditioning apparatus according to Embodiment 2 of the present invention.

FIG. 10 is a schematic perspective view showing the heat exchanger, the drain receiver, and the electric component box in the outdoor unit for an air-conditioning apparatus according to Embodiment 2 of the present invention. As shown in FIG. 10, the electric component box 81 is provided below the heat exchanger 51 of the outdoor unit 1. When dew condensation water from the heat exchanger 51 is drained to the upper portion of the electric component box 81, the dew condensation water enters the electric component box 81, and a problem of insulation failure occurs. Thus, a structure for assuredly draining dew condensation water from the heat exchanger 51 is required. Consequently, as shown in FIG. 10, the drain receiver 82 is provided at the upper portion of the electric component box 81, and dew condensation water dropping from the heat exchanger 51 is received by the drain receiver 82 and then drained to the outside of the outdoor unit 1.

Figure 11:
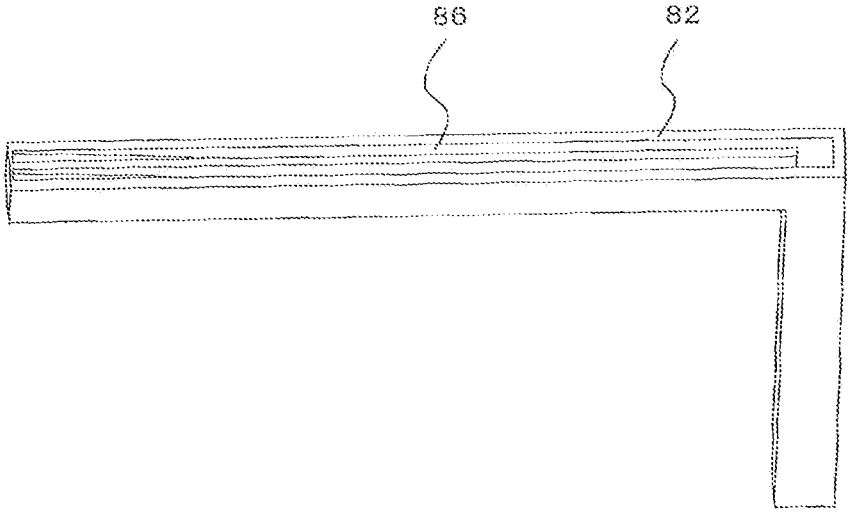
FIG. 11 is a schematic enlarged view of the drain receiver installed in the outdoor unit for an air-conditioning apparatus according to Embodiment 2 of the present invention.

FIG. 11 is a schematic enlarged view of the drain receiver installed in the outdoor unit for an air-conditioning apparatus according to Embodiment 2 of the present invention. As shown in FIG. 11, a groove 86 is formed in the drain receiver 82, and dew condensation water dropping from the heat exchanger 51 falls into the groove 86 and is drained to the outside of the outdoor unit 1 by flowing along the groove 86.

Figure 12:
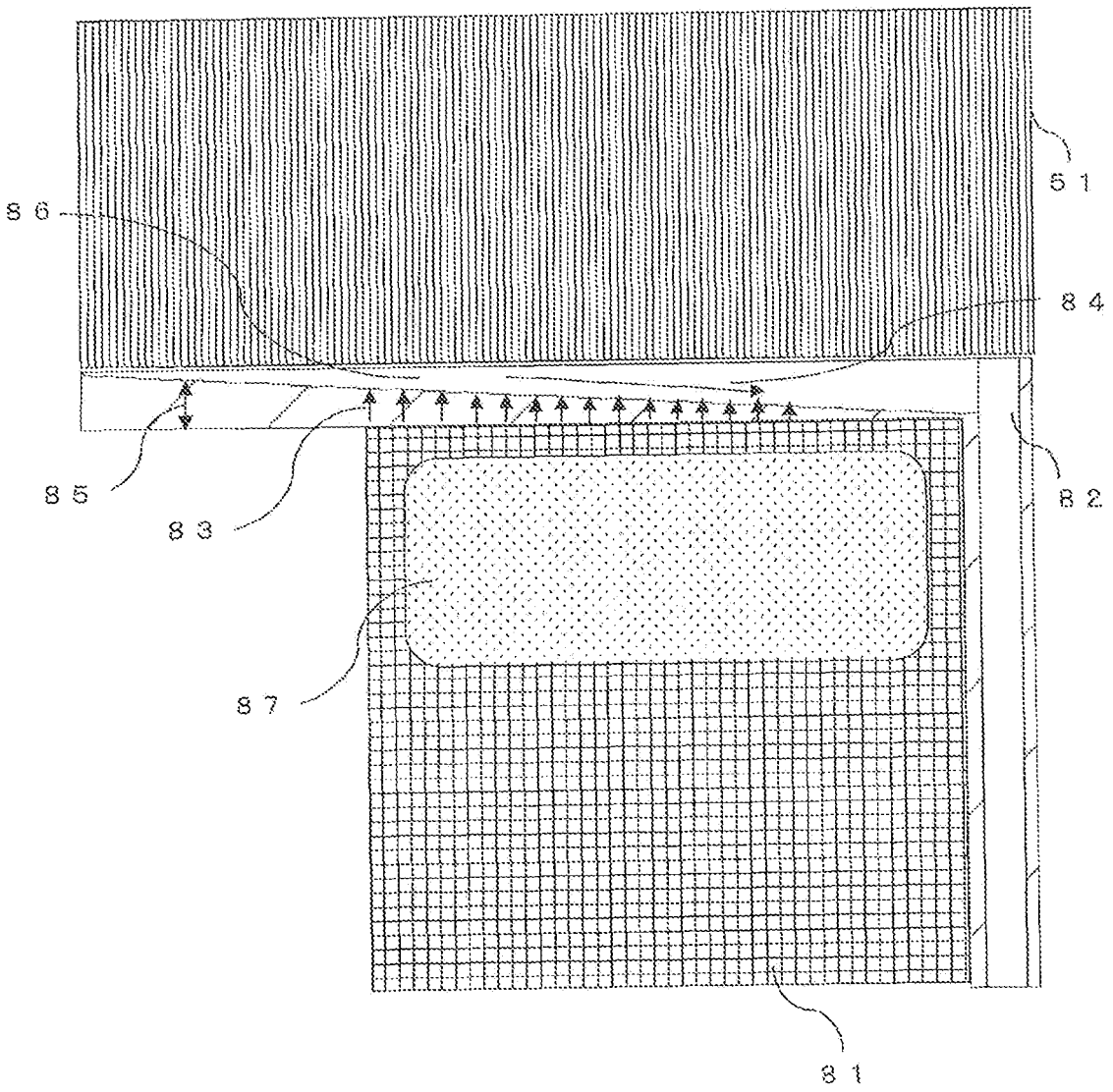
FIG. 12 is a schematic cross-sectional view of the heat exchanger, the drain receiver, and the electric component box installed in the outdoor unit for an air-conditioning apparatus according to Embodiment 2 of the present invention.

FIG. 12 is a schematic cross-sectional view of the heat exchanger, the drain receiver, and the electric component box installed in the outdoor unit for an air-conditioning apparatus according to Embodiment 2 of the present invention. In an environment in which the outside air temperature is below the freezing point, dew condensation water flowing out from the heat exchanger 51 may be frozen in the drain receiver 82. In this case, the draining function of the drain receiver 82 does not work. Thus, it is necessary to drain the dew condensation water received by the drain receiver 82 to the outside of the outdoor unit 1, regardless of the outside air temperature. To this end, by disposing the drain receiver 82 at the upper portion of the electric component box 81 and using rejected heat 83 from an internal component 87 in the electric component box 81 as shown in FIG. 12, the drain receiver 82 is prevented from being influenced by the outside air temperature. In this case, it is possible to effectively obtain the effect of the rejected heat 83 by disposing the internal component 87, which becomes high in temperature, at the upper portion of the electric component box 81. In addition, at a location in the drain receiver 82 at which the electric component box 81 is not present at the lower portion of the drain receiver 82, a slope 84 is provided to the groove 86 of the drain receiver 82, and a thickness 85 is ensured at the groove 86, thereby blocking the outside air.

Advantageous Effects of Embodiment 2

From the above, according to Embodiment 2, the outdoor unit 1 includes the electric component box 81 provided below the heat exchanger 51 and the drain receiver 82 provided at the upper portion of the electric component box 81 and below the heat exchanger 51, and the drain receiver 82 is configured to receive rejected heat from the electric component box 81. With this configuration, in addition to the advantageous effects of Embodiment 1, it is possible to obtain an effect of avoiding a problem of insulation failure that occurs by dew condensation water dropping from the heat exchanger 51 entering the electric component box 81.

Although Embodiment 1 and Embodiment 2 have been described above, the present invention is not limited to the description of each Embodiment. For example, the entirety or a part of each Embodiment may be combined.

The invention claimed is:

1. An outdoor unit for an air-conditioning apparatus comprising:
- a housing including a bottom plate, and a frame at an upper end portion of the housing;
- a heat exchanger disposed in the housing and including a plurality of fins arranged in parallel at intervals, and heat-transfer pipes penetrating the plurality of fins and arranged in a height direction at intervals; and
- a support member attached to the frame so that the heat exchanger is supported by the frame through the support member, perpendicularly extending from the frame, wherein
- the support member includes an engagement piece erected on the support member and holding the heat-transfer pipes, and
- the support member supports the heat exchanger such that the heat exchanger is away from the bottom plate.

2. The outdoor unit for an air-conditioning apparatus of claim 1, wherein
- the support member includes a support portion engaged with the frame,
- the support member supports the heat exchanger in the height direction and in a horizontal direction by the support portion being engaged with the frame, and
- the support member supports the heat exchanger in the height direction by the engagement piece holding the heat-transfer pipes.

3. The outdoor unit for an air-conditioning apparatus of claim 2, wherein
- the support member includes a support piece perpendicularly extending from an end portion of a center portion of the support portion, and having the engagement piece erected on the support member, and
- the support member has a T shape in a state where the support member is seen from a front.

4. The outdoor unit for an air-conditioning apparatus of claim 1, wherein
- the engagement piece is one of a plurality of engagement pieces erected in the height direction, and
- the engagement pieces are formed in a longitudinal direction of the support piece at regular intervals that are equal to those of a certain range of the heat-transfer pipes.

5. The outdoor unit for an air-conditioning apparatus of claim 4, wherein, at least one notch portion is provided between two adjacent ones of the engagement pieces to form at least one spring portion.

6. The outdoor unit for an air-conditioning apparatus of claim 1, wherein the engagement piece holds at least an uppermost one of the heat-transfer pipes.

7. The outdoor unit for an air-conditioning apparatus of claim 1, wherein the support member provides a gap between the frame and an upper end surface of the heat exchanger.

8. The outdoor unit for an air-conditioning apparatus of claim 1, wherein the support member is formed from a resin having flexibility.

9. The outdoor unit for an air-conditioning apparatus of claim 1, wherein the heat-transfer pipes are formed from aluminum or an alloy containing aluminum.

10. The outdoor unit for an air-conditioning apparatus of claim 1, wherein the heat-transfer pipes each have a flattened shape.

11. The outdoor unit for an air-conditioning apparatus of claim 1, further comprising:
- an electric component box provided below the heat exchanger; and
- a drain receiver provided at an upper portion of the electric component box and below the heat exchanger, wherein the drain receiver receives rejected heat from the electric component box.

12. A method of producing the outdoor unit for an air-conditioning apparatus of claim 1, the method comprising:

engaging the support member with the frame; and causing the engagement piece to hold the heat-transfer pipes such that the heat exchanger is away from the bottom plate.

* * * * *